US010772390B2

(12) United States Patent
Chiu et al.

(10) Patent No.: US 10,772,390 B2
(45) Date of Patent: Sep. 15, 2020

(54) BUCKLE DEVICE

(71) Applicant: BROGENT TECHNOLOGIES INC., Kaohsiung (TW)

(72) Inventors: Shih-Kuang Chiu, Kaohsiung (TW); Po-Tsun Chen, Kaohsiung (TW); Juei-Tsung Chen, Kaohsiung (TW)

(73) Assignee: BROGENT TECHNOLOGIES INC., Kaohsiung (TW)

( * ) Notice: Subject to any disclaimer, the term of this patent is extended or adjusted under 35 U.S.C. 154(b) by 0 days.

(21) Appl. No.: 16/654,453

(22) Filed: Oct. 16, 2019

(65) Prior Publication Data

US 2020/0221830 A1 Jul. 16, 2020

(30) Foreign Application Priority Data

Jan. 11, 2019 (TW) ..... 108101244 A

(51) Int. Cl.
*A44B 11/25* (2006.01)

(52) U.S. Cl.
CPC ..... *A44B 11/2523* (2013.01)

(58) Field of Classification Search
CPC ..... A44B 11/2523
See application file for complete search history.

(56) References Cited

U.S. PATENT DOCUMENTS 2,921,353 A * 1/1960 Cushman ..... A44B 11/2542 24/632
4,899,424 A * 2/1990 Barnes ..... A44B 11/2523 24/637
4,928,366 A * 5/1990 Ballet ..... A44B 11/2523 24/636
5,542,162 A * 8/1996 Biller ..... A44B 11/2523 24/641
5,606,779 A * 3/1997 Lu ..... A43C 11/146 24/68 SK
5,742,987 A * 4/1998 Mikulec ..... A44B 11/2523 24/633
5,915,633 A * 6/1999 Biller ..... A44B 11/2523 24/641
6,158,092 A * 12/2000 Huang ..... B60P 7/0838 24/68 CD
9,402,446 B2 * 8/2016 Haas ..... A44B 11/2569
2004/0000038 A1 * 1/2004 Steiff ..... B64D 17/38 24/164
2004/0107550 A1 * 6/2004 Lee ..... B60R 21/01546 24/633
2004/0111845 A1 * 6/2004 Lee ..... B60R 21/01546 24/633

FOREIGN PATENT DOCUMENTS

TW M473859 U 3/2014

* cited by examiner

*Primary Examiner* — Robert Sandy
*Assistant Examiner* — David M Upchurch
(74) *Attorney, Agent, or Firm* — Muncy, Geissler, Olds & Lowe, P.C.

(57) ABSTRACT

A buckle device comprises a main unit, a disk unit, a press unit, and an elastic unit. The main unit includes a housing. The disk unit includes at least one vertical disk. The press unit includes a press body. The elastic unit includes a first spring body. One end of the first spring body is disposed on the vertical disk. The other end of the first spring body is disposed on the press body. The first spring body is a thrust spring to extend the lifespan of the buckle device.

10 Claims, 6 Drawing Sheets

BUCKLE DEVICE

BACKGROUND OF THE INVENTION

1. Field of the Invention

The present invention relates to a buckle device, more particularly to a buckle device disposed on a chair.

2. Description of the Prior Art

A motion simulation chair is provided with a fixing strap and a latch for fixing the occupant to the chair and prevent the occupant from being ejected when the chair provides motion simulation.

Please refer to the Taiwanese Patent No. M473859, a latch 1 used for seatbelt is disclosed, in which the plate of the latch 1 can be controlled to prevent the occupant's accidental open, and furthermore, it can protect the occupant when the seat provides motion simulation.

Please refer to FIG. 1, the latch 1 comprises a first horizontal rod 102 disposed in a casing 101, two first connecting regions 103 disposed on the first horizontal rod 102, a second horizontal rod 104 disposed in a casing 101, two vertical disks 105 pivotally disposed on the second horizontal rod 104, two second connecting regions 106 disposed on the two vertical disk 105, and two first springs 107 disposed on the first connection region 103 and the second connection region 106. The two first spring 107 are tension springs for pulling the two vertical disk 105 to rotate in the casing 101. Both ends of the two first springs 107 are respectively provided with a circular first fastener 108, and plural first fasteners 108 respectively engage with the two first connecting regions 103 and the two second connecting regions 106.

Please refer to FIG. 2, the latch 1 further comprises a third horizontal rod 109 disposed on the casing 101, a press member 110 disposed in the casing 101, two third connecting regions 111 disposed on the press member 110, and two second springs 112 disposed between the third horizontal rod 109 and the third connecting region 111. The two second springs 112 are tension springs for pulling the press member 110 to move in the casing 101. Both ends of the two second springs 112 are respectively provided with a circular second fastener 113, and plural second fasteners 113 are respectively engage with the third horizontal rod 109 and the two third connecting regions 111.

Please refer to FIG. 3, the latch 1 further comprises a fourth horizontal rod 114 disposed on the casing 101, two electromagnetic components 115 disposed on the casing 101, two metal bars 116 pivotally disposed on the two electromagnetic components 115, two fourth connecting regions 117 disposed on the two metal bars 116, and two third springs 118 disposed between the fourth horizontal rod 114 and the fourth connecting region 117 are disposed. The two third springs 118 are tension springs for pulling the two metal bars 116 to move in the casing 101. Both ends of the two third springs 118 are respectively provided with a circular third fastener 119, and plural third fasteners 119 are respectively engage with the fourth horizontal rod 114 and the fourth connecting region 117.

The junction where the first spring 107 and the first fastener 108 connected, the junction where the second spring 112 and the second fastener 113 connected, and the junction where the third spring 118 and the third fastener 119 connected, will become brittle over time and break easily due to spring fatigue.

Therefore, the following drawbacks and disadvantages still exist with prior art invention:

1. Insufficient Durability

The prior art invention uses a tension spring, and annular fasteners must be configured on both sides of the tension spring to fasten two objects and provide a tensile force between the two objects. However, the junction between the tension spring and the annular fastener is easy to become brittle after a certain number of expansions, and the durability is obviously insufficient.

2. Complex Assembly

Each fastener must be engaged with a connecting region disposed on the object. The fastener components are various and must be assembled according to a tedious standard procedure. For example, the third horizontal rod 109 of the prior art is not only provided to the second fastener 113 of the second spring 112 for engagement, but also has to pass through the press member 110 for controlling the movement of the press member 110, which increases difficulty of assembly.

3. Complicated Structure

Each movable object must be provided with a spring and a fixing member fixed to the casing. The second connecting region 106 and the fourth connecting region 117 of the prior art are screw parts, and the first connecting region 103 and the third connecting region 111 are convex structure, which requires various and abundant springs. Therefore, the structure of the conventional latch is complicated.

Therefore, it is desirable to provide a buckle with high durability and simple structure.

SUMMARY OF THE INVENTION

Therefore, an objective of an embodiment of the present invention is to provide a buckle device, comprising a main unit, at least one disk unit, a press unit, and an elastic unit.

The main unit includes a housing surrounding a housing space, a disk support body disposed in the housing space, and a press support body disposed in the housing space.

The disk unit includes at least a vertical disk pivotally connected to the disk support body, a first clamping region disposed on the vertical disk, a spring housing disposed on the vertical disk, a spring disk support region disposed on the vertical disk, and a rotation limiting region disposed on the vertical disk, wherein the vertical disk is movable between a disk latched position and an disk unlatched position, and the press support body presses against the rotation limiting region.

The press unit includes a press body disposed on the housing, at least one press limiting through-hole disposed on the press body, at least one press latching region disposed on the press body, and at least one spring press support region disposed on the press body, when the vertical disk located at the disk latched position, the press support body cooperating with the press limiting through-hole, the press body being movable between a press latched position and an press unlatched position, when the press body located at the press latched position, the first clamping region engaged with the press latching region to fasten the vertical disk located at the disk latched position.

The elastic unit includes at least one first spring body, wherein the first spring body is a thrust spring, the spring disk support region supporting one end of the first spring body, the spring press support region supporting the other end of the first spring body, the spring housing accommodating the first spring body, the first spring body pushing the vertical disk to the disk unlatched position, and the first spring body pushing the press body to the press latched position.

Another technique of an embodiment of the present invention is that the spring disk support region protrudes from convex of the vertical disk, and one end of the first spring body is sleeved on the spring disk support region.

Another technique of an embodiment of the present invention is that the spring press support region protrudes from convex of the press body, and the other end of the first spring body is sleeved on the spring press support region.

Another technique of an embodiment of the present invention is that the spring disk support region is disposed at a side of the spring housing, and the vertical disk is pushed by the first spring body.

Another technique of an embodiment of the present invention is that the disk unit further includes a protrusion disposed on the vertical disk, and the protrusion presses against a side of an end of the first spring body.

Another technique of an embodiment of the present invention is that the disk unit further includes a spout stop region disposed on the rotation limiting region, and the spout stop region controls rotation angle when the vertical disk is located at the disk unlatched position.

Another technique of an embodiment of the present invention is that the present invention is detachable to combine with a latch plate device, wherein the latch plate device is provided with a tongue, the main unit further including an insertion slot disposed on the housing, the insertion slot provided for tongue insertion, the disk unit further including a second clamping region disposed on the vertical disk, when the press body is located at the press latched position, the tongue engaged with the second clamping region, and the latch plate device not able to be separated from the buckle device.

Another technique of an embodiment of the present invention is that the present invention further comprises at least one magnetic engagement unit, wherein the magnetic engagement unit includes an electromagnetic body disposed on the housing, an electromagnetic retractable rod pivotally disposed on the electromagnetic body, and an electromagnetic latching region disposed on the electromagnetic retractable rod, the disk unit further including a third clamping region disposed on the vertical disk, the elastic unit further including at least one second spring body, when the vertical disk located at the disk latched position, the electromagnetic retractable rod moving between an electromagnetic latched position and an electromagnetic unlatched position, the electromagnetic body pushing the electromagnetic retractable rod to the electromagnetic unlatched position, the second spring body pushing the electromagnetic retractable rod to the electromagnetic latched position, when the electromagnetic retractable rod is moved to the electromagnetic latched position, the electromagnetic latching region engaged with the third clamping region to fasten the vertical disk on the disk latched position.

Another technique of an embodiment of the present invention is that the magnetic engagement unit further includes a spring magnet support region disposed on the electromagnetic body, and a spring rod support region disposed on the electromagnetic retractable rod, the second spring body being a thrust spring, the second spring body sleeved on the electromagnetic retractable rod, the spring magnet support region supporting one end of the second spring body, and the spring rod support region supporting the other end of the second spring body.

Another technique of an embodiment of the present invention is that the main unit further includes a rod support body disposed in the housing space, the magnetic engagement unit further including a rod limiting hole disposed on the electromagnetic retractable rod, the rod support body cooperating with the rod limiting hole to control the position of the electromagnetic retractable rod moving between the electromagnetic unlatched position and the electromagnetic latched position.

The advantage of the present invention is that the spring disk support region and the spring press support region are designed to provide an arrangement which the first spring body doesn't need an annular fastener, and the first spring body is a thrust spring. This arrangement can extend the lifespan of the buckle device and the press body is rotated by the thrust of the first spring body to push the press body, which maintains the basic function of the buckle device.

DETAILED DESCRIPTION OF THE PREFERRED EMBODIMENTS

Specific structural and functional details disclosed herein will become apparent from the following description of the preferred embodiment of the present invention taken in conjunction with the accompanying drawings, which provides better understanding to a person having ordinary skill in the art but shall not be construed as limiting the invention.

Figure 1:
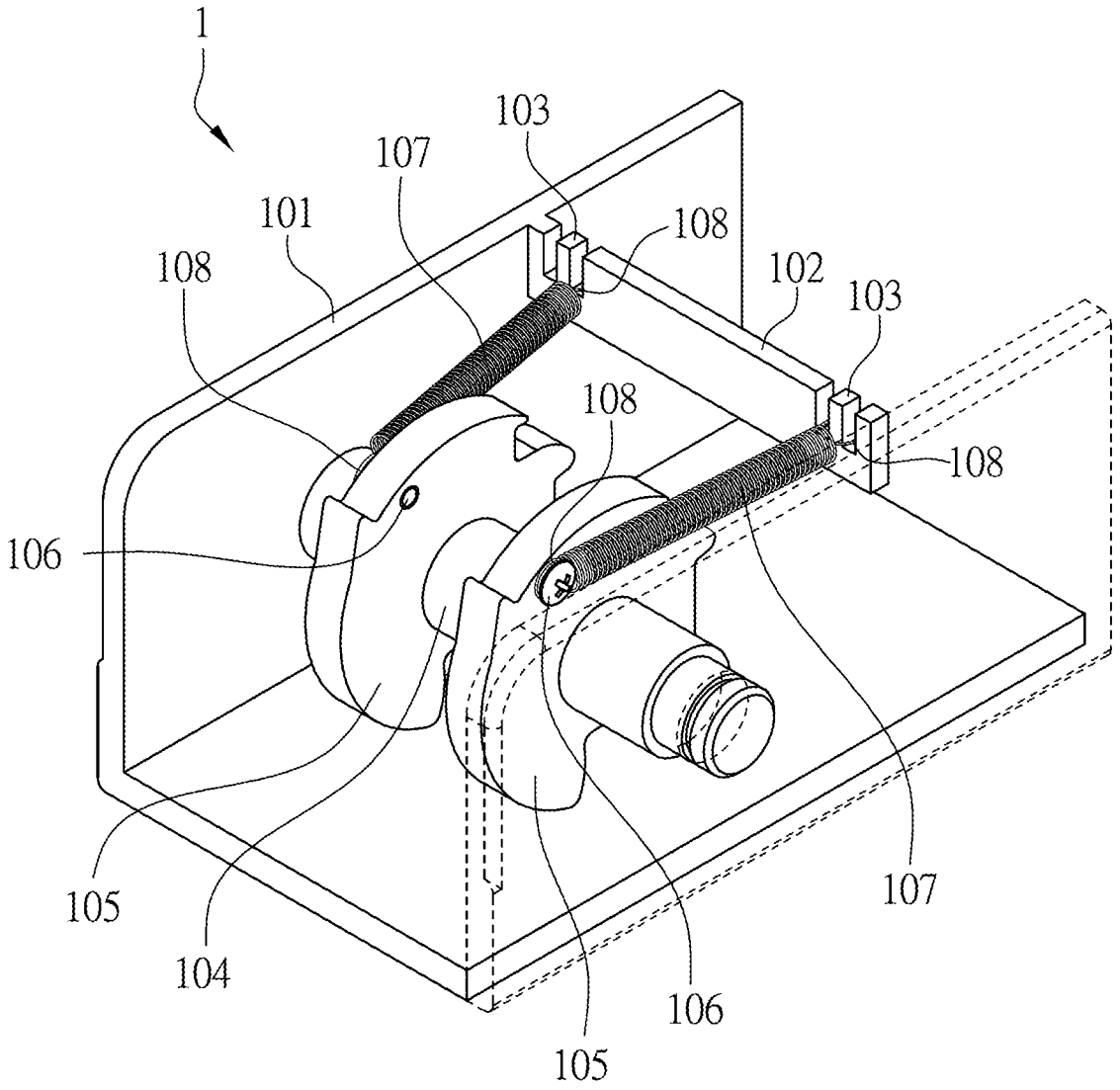
FIG. 1 (prior art)
FIG. 1 illustrates the arrangement of a first spring of a prior art invention.
Figure 2:
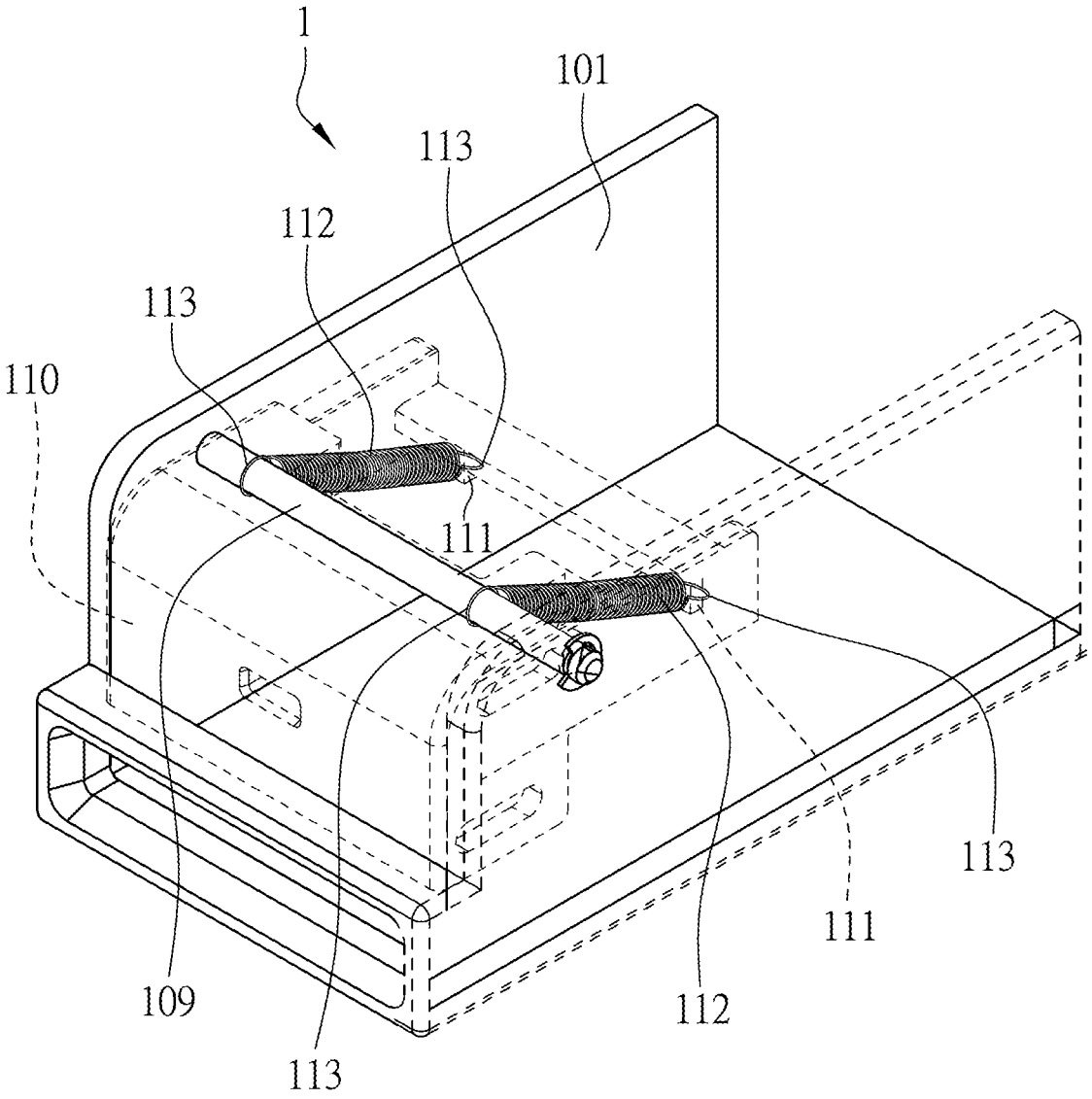
FIG. 2 (prior art)
FIG. 2 illustrates the arrangement of a second spring of the prior art invention.
Figure 3:
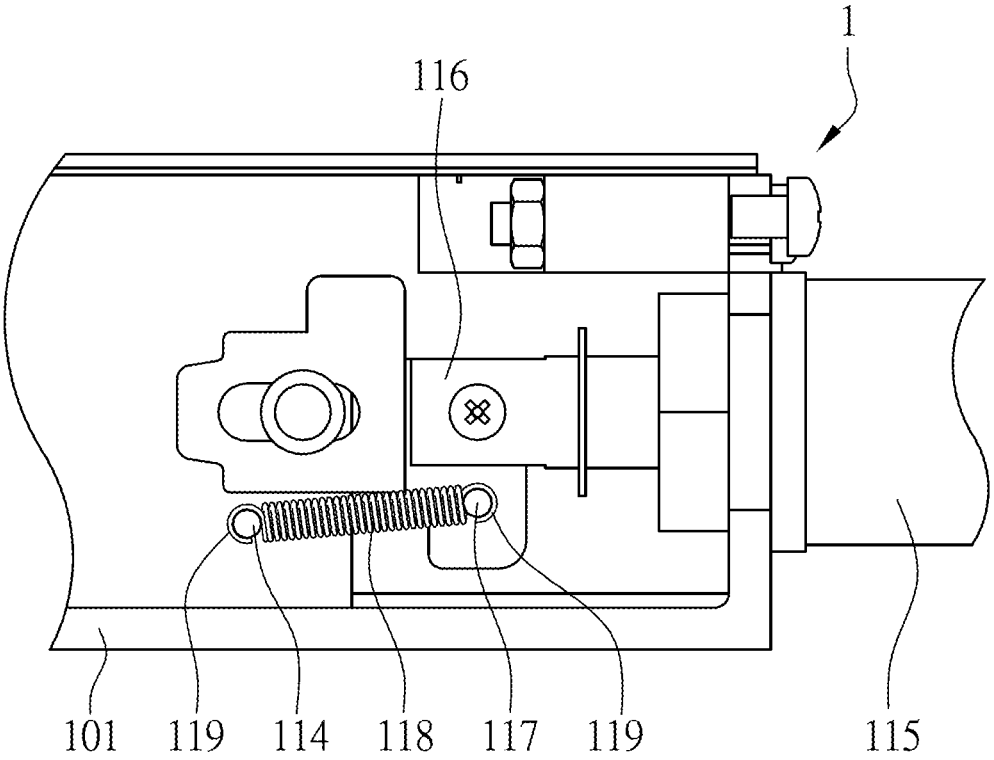
FIG. 3 (prior art)
FIG. 3 illustrates the arrangement of a third spring of the prior art invention.
Figure 4:
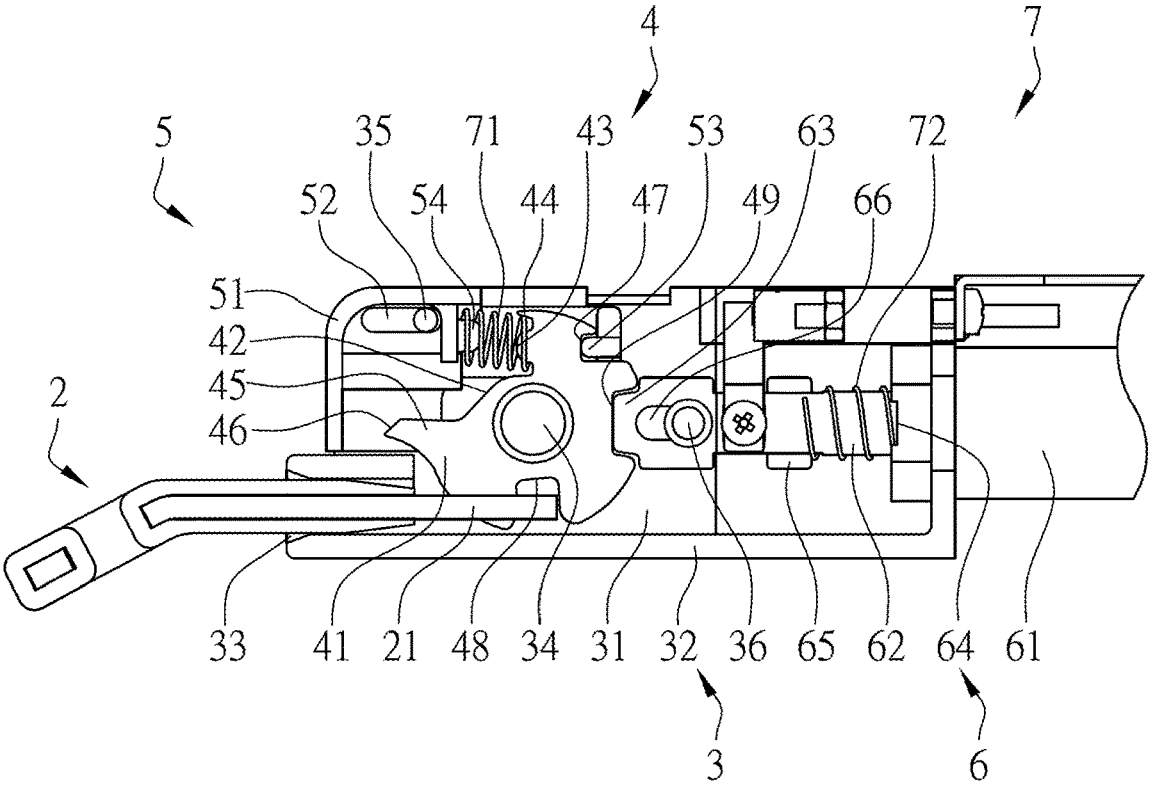
FIG. 4 illustrates an embodiment of the present buckle device in which a latch plate device is engaged with the buckle device, a vertical disk located at the disk latched position, a press body located at a press latched position, and an electromagnetic retractable rod located at an electromagnetic latched position.

Please refer to FIG. 4., a preferred embodiment according to the buckle device, wherein the buckle device is detachable to combine with a latch plate device 2. The latch plate device 2 is provided with a tongue 21.

In the preferred embodiment, the buckle device comprises a main unit 3, two disk unit 4, a press unit 5, two magnetic engagement unit 6 and an elastic unit 7.

The main unit 3 includes a housing 32 surrounding a housing space 31, an insertion slot 33 disposed on the housing 32, a disk support body 34 disposed in the housing space 31, a press support body 35 disposed in the housing space 31, and a rod support body 36 disposed in the housing space 31.

Each disk unit 4 includes a vertical disk 41 pivotally connected to the disk support body 34, a spring housing 42 disposed on the vertical disk 41, a spring disk support region 43 disposed on the vertical disk 41, a protrusion 44 disposed on the vertical disk 41, a rotation limiting region 45 disposed on the vertical disk 41, a spout stop region 46 disposed on the rotation limiting region 45, a first clamping region 47 disposed on the vertical disk 41, a second clamping region 48 disposed on the vertical disk 41, and a third clamping region 49 disposed on the vertical disk 41.

The press unit 5 includes a press body 51 disposed on the housing 32, two press limiting through-holes 52 disposed on the press body 51, two press latching region 53 disposed on the press body 51, and two spring press support regions 54 disposed on the press body 51.

Each magnetic engagement unit 6 includes an electromagnetic body 61 disposed on the housing 32, an electromagnetic retractable rod 62 pivotally disposed on the electromagnetic body 61, an electromagnetic latching region 63 disposed on the electromagnetic retractable rod 62, a spring magnet support region 64 disposed on the electromagnetic body 61, a spring rod support region 65 disposed on the electromagnetic retractable rod 62, and a rod limiting hole 66 disposed on the electromagnetic retractable rod 62.

The elastic unit 7 includes two first spring bodies 71 disposed between the spring disk support region 43 and the spring press support region 54, and two second spring bodies 72 disposed between the spring magnet support region 64 and the spring rod support region 65.

The number of the disk unit 4, the press limiting through-hole 52, the press latching region 53, the spring press support region 54, the first spring body 71 and the second spring body 72, depends on different situations and shall not be construed as limiting the invention.

The tongue 21 is disposed on one end of the latch plate device 2, and the other end of the latch plate device 2 is coupled to a seat belt of the seat. Based upon the number of the disk units 4, the tongue 21 is provided with two fastening holes, and the insertion slot 33 of the main unit 3 provides the tongue 21 of the latch plate device 2 for insertion. The number of the fastening hole on the tongue 21 should match the number of the disk unit 4, and shall not be construed as limiting the invention.

In the preferred embodiment, the disk support body 34, the press support body 35, and the rod support body 36 are circular cylinders horizontally disposed in the housing space 31, and the disk support body 34, the press support body 35, and the both ends of the rod support body 36 are fixed to the housing 32.

The first spring body 71 is a thrust spring, the spring disk support region 43 supporting one end of the first spring body 71, the spring press support region 54 supporting the other end of the first spring body 71. The spring disk support region 43 protrudes from convex of the vertical disk 41, and one end of the first spring body 71 is sleeved on the spring disk support region 43. The spring press support region 54 protrudes from convex of the press body 51, and the other end of the first spring body 71 is sleeved on the spring press support region 54.

It is noted that the first spring body 71 is a thrust spring, and one end of the first spring body 71 is sleeved on the spring disk support region 43 which can push the vertical disk 41 to rotate. The other end of the first spring body 71 is sleeved on the spring press support region 54 which can push the press body 51 to move. The conventional design with the tension springs requires annular fasteners disposed on both ends of the tension spring to provide the tension between the two objects, and the junction where the annular fastener and the tension spring connected will become brittle due to metal fatigue. Therefore, the present invention can avoid the aforementioned disadvantages, and indeed extend the lifespan of the buckle device.

The vertical disk 41 appears like a plate. The disk support body 34 is disposed at the center of the vertical disk 41. The spring housing 42 is a groove on the outer edge of the vertical disk 41. The spring disk support region 43 is disposed at a side of the spring housing 42, so that the first spring body 71 can push the vertical disk 41 to rotate, and the spring housing 42 can accommodate the first spring body 71. The protrusion 44 is disposed on the outer side of the vertical disk 41, and the protrusion 44 presses against the outer side of one end of the first spring body 71 sleeved on the spring disk support region 43, which prevents one end of the first spring body 71 from exceeding outer edge of the vertical disk 41. Furthermore, it can prevent the first spring body 71 from interfering with other components and prevent awkward rotation of the vertical disk 41.

The vertical disk 41 is rotatable on the disk support body 34, and the vertical disk 41 rotates between a disk latched position and a disk unlatched position.

The tongue 21 can be inserted into the housing space 31 of the main unit 3 via the insertion slot 33, when the tongue 21 of the latch plate device 2 inserts into the housing space 31 via the insertion slot 33, the tongue 21 can push the vertical disk 41 to the disk latched position.

The second spring body 72 is a thrust spring, the second spring body 72 sleeved on the electromagnetic retractable rod 62, the spring magnet support region 64 supporting one end of the second spring body 72, and the spring rod support region 65 supporting the other end of the second spring body 72. The second spring body 72 can push the electromagnetic retractable rod 62 to move to the electromagnetic latched position.

When the electromagnetic body 61 is powered up, the thrust of the second spring body 72 can be resisted to push the electromagnetic retractable rod 62 to the electromagnetic unlatched position, and when the electromagnetic body 61 is not powered up, the second spring body 72 can push the electromagnetic retractable rod 62 to move.

The rod support body 36 cooperates with the rod limiting hole 66 to control position of the electromagnetic retractable rod 62 moving between the electromagnetic unlatched position and the electromagnetic latched position.

Figure 5:
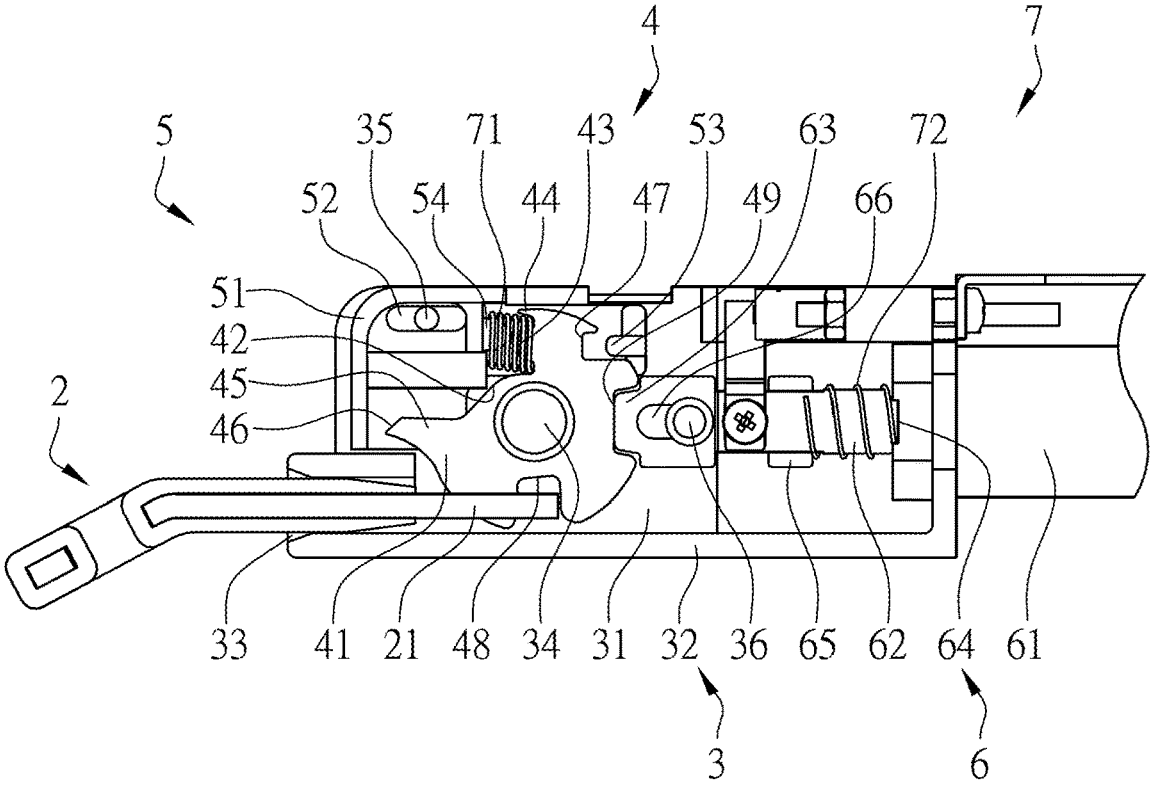
FIG. 5 illustrates the embodiment of the present buckle device in which the vertical disk is located at the disk latched position, the press body located at a press unlatched position, and the electromagnetic retractable rod located at the electromagnetic latched position.

Please refer to FIGS. 4 and 5, when the vertical disk 41 is located at the disk latched position, the press support body 35 cooperates with the press limiting through-hole 52, so that the press body 51 moves between a press latched position and a press unlatched position.

When the press body 51 is located at the press latched position, the first spring body 71 can push the press body 51 to the press latched position, and the first clamping region 47 is engaged with the press latching region 53, so that the vertical disk 41 can be fastened on the disk latched position.

The press body 51 can receive an external force to resist the thrust of the first spring body 71, so that the press body 51 can move to the press unlatched position.

The electromagnetic latching region 63 is engaged with the third clamping region 49. Therefore, when the press body 51 is located at the press unlatched position, the first clamping region 47 is separated from the press latching region 53, and the vertical disk 41 won't rotate and fixed to the disk latched position.

Figure 6:
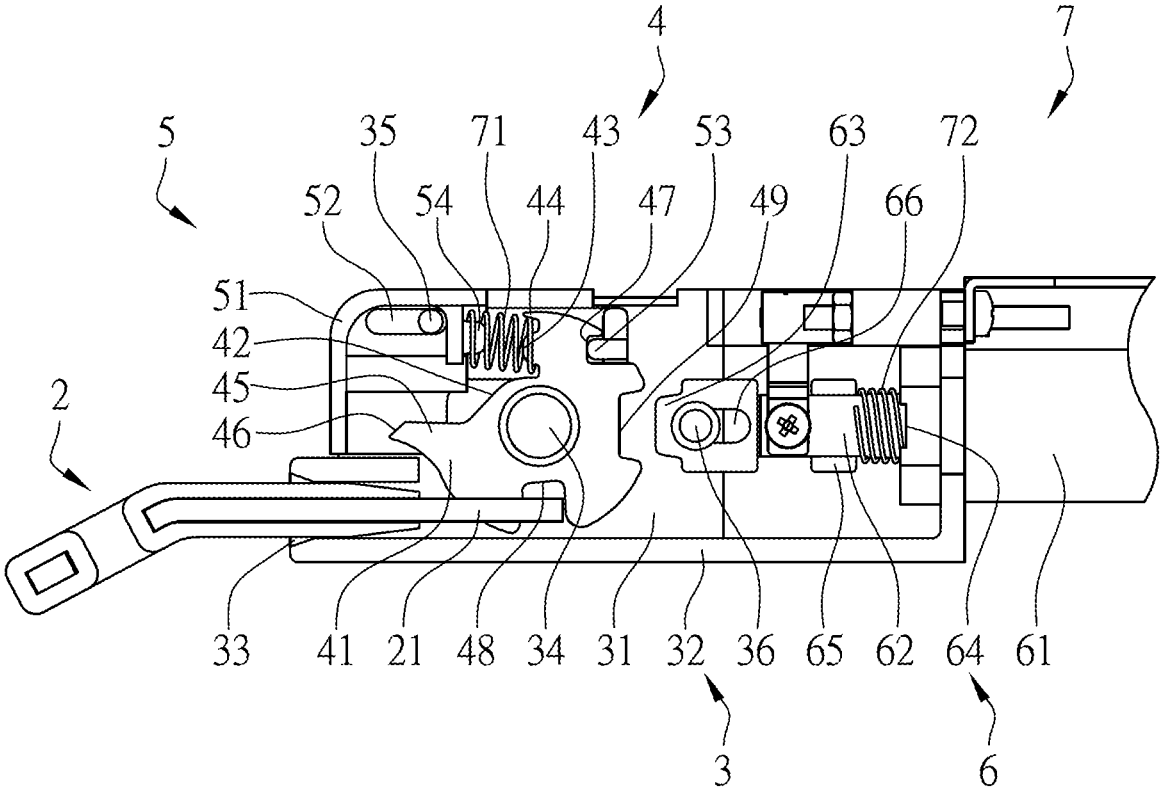
FIG. 6 illustrates the embodiment of the present buckle device in which the vertical disk is located at the disk latched position, the press body located at the press latched position, and the electromagnetic retractable rod located at an electromagnetic unlatched position.

Please refer to FIGS. 4 and 6, when the vertical disk 41 is located at the disk latched position, the electromagnetic retractable rod 62 is movable between an electromagnetic latched position and an electromagnetic unlatched position. The electromagnetic body 61 pushes the electromagnetic retractable rod 62 to the electromagnetic unlatched position, and the second spring body 72 pushes the electromagnetic retractable rod 62 to the electromagnetic latched position.

When the electromagnetic retractable rod 62 is moved to the electromagnetic latched position, the electromagnetic latching region 63 is engaged with the third clamping region 49, so that the vertical disk 41 is fastened to the disk latched position.

When the electromagnetic retractable rod 62 is moved to the electromagnetic unlatched position, the tongue 21 is engaged with the second clamping region 48 because the press body 51 is located at the press latched position, and the vertical disk 41 won't be rotated and is fixed to the disk latched position.

When the vertical disk 41 is fixed to the disk latched position by the press body 51 or the electromagnetic retractable rod 62, the tongue 21 of the latch plate device 2 cannot be separated from the buckle device.

Figure 7:
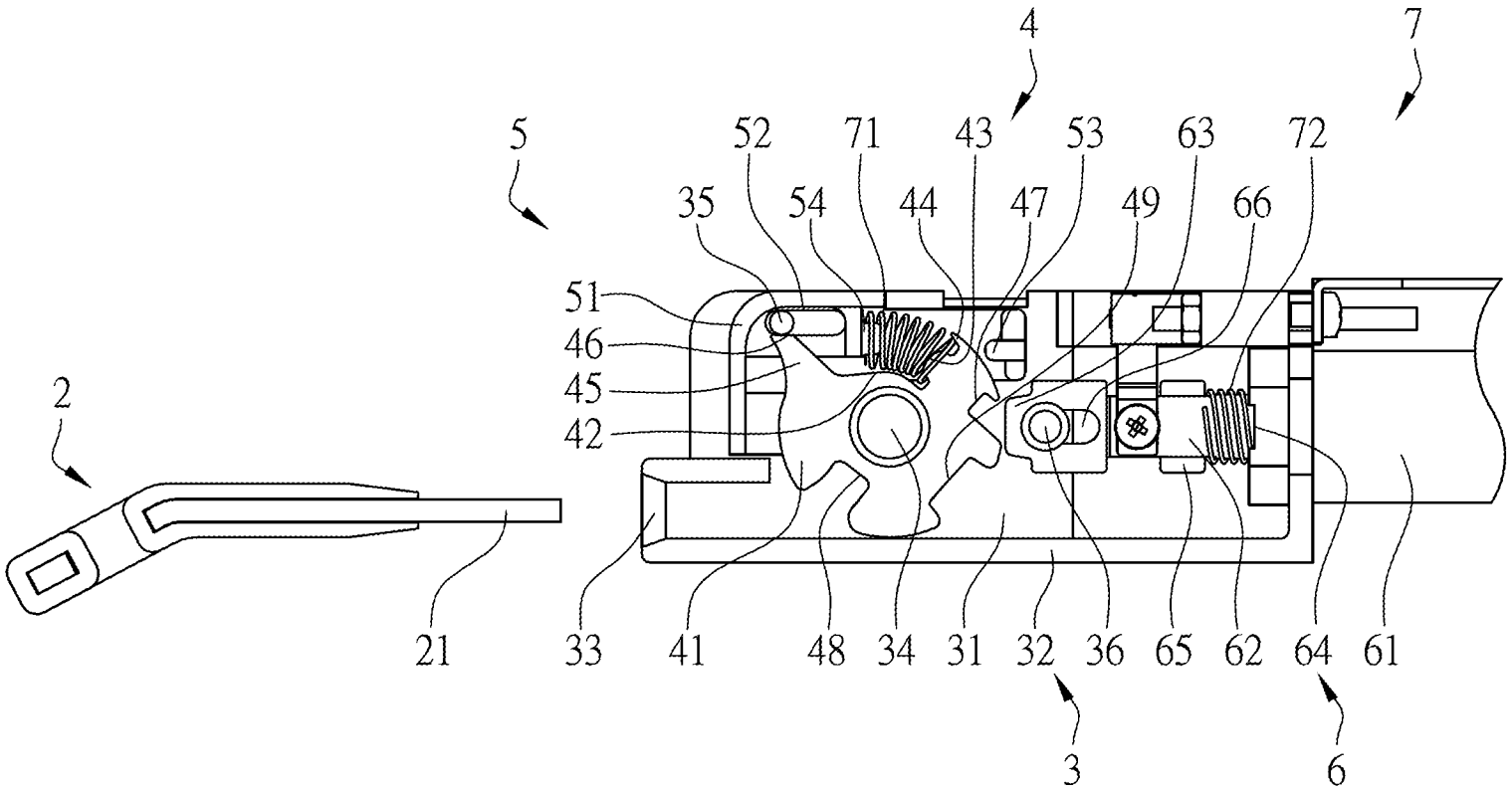
FIG. 7 illustrates the embodiment of the present buckle device in which the latch plate device is separated from the buckle device, the vertical disk located at a disk unlatched position, the press body located at a press unlatched position, and the electromagnetic retractable rod located at the electromagnetic unlatched position.

Please refer to FIG. 7, when the press body 51 is located at the press unlatched position, and meanwhile the electromagnetic retractable rod 62 is located at the electromagnetic unlatched position, the first spring body 71 can push the vertical disk 41 to rotate and cooperates with the press support body 35 to press against the rotation limiting region 45, so that the vertical disk 41 can move to the disk unlatched position.

The rotation limiting region 45 protrudes from the outer edge of the vertical disk 41, and the rotation limiting region 45 pushes against the first spring body 71 providing the thrust to the vertical disk 41, so that the vertical disk 41 is located at the disk unlatched position.

The spout stop region 46 is a beveled edge on the convex of the rotation limiting region 45, and the spout stop region 46 controls the rotation angle of the vertical disk 41 located at the disk unlatched position.

When the press body 51 is pushed by the external force to the press unlatched position, and meanwhile the electromagnetic retractable rod 62 is pushed by the electromagnetic body 61 to the electromagnetic unlatched position, the first spring body 71 can push the vertical disk 41 to the disk unlatched position, and the tongue 21 of the latch plate device 2 is pushed outward.

With above description, the present buckle device has following benefits:

1. Extended Lifespan

The first spring body 71 and the second spring body 72 of the present invention are thrust springs, which can improve the drawback of tension spring caused by metal elastic fatigue and extend the lifespan of the present buckle device.

2. Smooth Spring Movement

The protrusion 44 can be supported on the outer side of one end of the first spring body 71 sleeved on the spring disk support region 43, which prevents one end of the first spring body 71 from exceeding the vertical disk 41. Furthermore, it can prevent the first spring body 71 from interfering with other components, so that the first spring body 71 can push the vertical disk 41 to rotate smoothly.

3. Accurate Control of Position

The spout stop region 46 is a beveled edge of the convex of the rotation limiting region 45, and the first spring body 71 can be accurately provided to push the vertical disk 41 to the disk unlatched position, and the tongue 21 of the latch plate device 2 is pushed outward, so that the rotation limiting region 45 is prevented from interfering with the press body 51 to generate structural friction.

In conclusion, the first spring body 71 and the second spring body 72 of the present invention are thrust springs, and the vertical disk 41 is provided with the spring housing 42, the spring disk support region 43 and the protrusion 44. The press body 51 is provided with the spring press support region 54, so that the first spring body 71 can respectively rotate the vertical disk 41 and move the press body 51, which effectively reducing the number of springs and maintaining the movement of the buckle device. Furthermore, because the first spring body 71 and the second spring body 72 are thrust springs, metal elastic fatigue can be prevented, and extend the lifespan of the present buckle device. Therefore, the objective of the present invention can be obtained.

Although the present invention has been explained in relation to its preferred embodiment, it is to be understood that many other possible modifications and variations can be made without departing from the scope of the invention as hereinafter claimed.

What is claimed is:

1. A buckle device comprising:

a main unit includes a housing surrounding a housing space, a disk support body disposed in the housing space, and a press support body disposed in the housing space;

at least one disk unit includes a vertical disk pivotally connected to the disk support body, a first clamping region disposed on the vertical disk, a spring housing disposed on the vertical disk, a spring disk support region disposed on the vertical disk, and a rotation limiting region disposed on the vertical disk, wherein the vertical disk is movable between a disk latched position and an disk unlatched position, and the press support body presses against the rotation limiting region;

a press unit includes a press body disposed on the housing, at least one press limiting through-hole disposed on the press body, at least one press latching region disposed on the press body, and at least one spring press support region disposed on the press body, when the vertical disk located at the disk latched position, the press support body cooperating with the press limiting through-hole, the press body being movable between a press latched position and an press unlatched position, when the press body located at the press latched position, the first clamping region engaged with the press latching region to fasten the vertical disk on the disk latched position; and an elastic unit includes at least one first spring body, wherein the first spring body is a thrust spring, the spring disk support region supporting one end of the first spring body, the spring press support region supporting the other end of the first spring body, the spring housing accommodating the first spring body, the first spring body pushing the vertical disk to the disk unlatched position, and the first spring body pushing the press body to the press latched position.

2. The buckle device as claimed in claim 1, wherein the spring disk support region protrudes from convex of the vertical disk, and one end of the first spring body is sleeved on the spring disk support region.

3. The buckle device as claimed in claim 1, wherein the spring press support region protrudes from convex of the press body, and the other end of the first spring body is sleeved on the spring press support region.

4. The buckle device as claimed in claim 1, wherein the spring disk support region is disposed at a side of the spring housing, and the vertical disk is pushed by the first spring body.

5. The buckle device as claimed in claim 1, wherein the disk unit further includes a protrusion disposed on the vertical disk, and the protrusion presses against a side of an end of the first spring body.

6. The buckle device as claimed in claim 1, wherein the disk unit further includes a spout stop region disposed on the rotation limiting region, and the spout stop region controls rotation angle when the vertical disk is located at the disk unlatched position.

7. The buckle device as claimed in claim 1 detachable to combine with a latch plate device, wherein the latch plate device is provided with a tongue, the main unit further including an insertion slot disposed on the housing, the insertion slot provided for insertion of the tongue, the disk unit further including a second clamping region disposed on the vertical disk, when the press body is located at the press latched position, the tongue engaged with the second clamping region, the latch plate device not able to be separated from the buckle device.

8. The buckle device as claimed in claim 1, further comprising at least one magnetic engagement unit, wherein the magnetic engagement unit includes an electromagnetic body disposed on the housing, an electromagnetic retractable rod pivotally disposed on the electromagnetic body, and an electromagnetic latching region disposed on the electromagnetic retractable rod, the disk unit further including a third clamping region disposed on the vertical disk, the elastic unit further including at least one second spring body, when the vertical disk located at the disk latched position, the electromagnetic retractable rod moving between an electromagnetic latched position and an electromagnetic unlatched position, the electromagnetic body pushing the electromagnetic retractable rod to the electromagnetic unlatched position, the second spring body pushing the electromagnetic retractable rod to the electromagnetic latched position, when the electromagnetic retractable rod is moved to the electromagnetic latched position, the electromagnetic latching region engaged with the third clamping region to fasten the vertical disk on the disk latched position.

9. The buckle device as claimed in claim 8, wherein the magnetic engagement unit further including a spring magnet support region disposed on the electromagnetic body, and a spring rod support region disposed on the electromagnetic retractable rod, the second spring body being a thrust spring, the second spring body sleeved on the electromagnetic retractable rod, the spring magnet support region supporting one end of the second spring body, and the spring rod support region supporting the other end of the second spring body.

10. The buckle device as claimed in claim 8, wherein the main unit further includes a rod support body disposed in the housing space, the magnetic engagement unit further including a rod limiting hole disposed on the electromagnetic retractable rod, the rod support body cooperating with the rod limiting hole to control the position of the electromagnetic retractable rod moving between the electromagnetic unlatched position and the electromagnetic latched position.

* * * * *